United States Patent [19]

Cremona

[11] 4,137,957

[45] Feb. 6, 1979

[54] WOOD STOCK SUPPORT CONSTRUCTION FOR A BLADE HOLDER AND BAR CARRYING UNIT OF A VERTICAL TYPE WOOD SHEARING MACHINE

[76] Inventor: Angelo Cremona, Viale Lombardia 275, Monza, Italy

[21] Appl. No.: 842,530

[22] Filed: Oct. 14, 1977

[30] Foreign Application Priority Data

May 12, 1977 [IT] Italy ..... 23486 A/77

[51] Int. Cl.[2] ..... B27C 1/14

[52] U.S. Cl. ..... 144/178; 144/209 A

[58] Field of Search ..... 144/177, 178, 179, 209 R, 144/209 A, 214

[56] References Cited

U.S. PATENT DOCUMENTS 3,152,626 10/1964 Nicholson ..... 144/209 R

*Primary Examiner*—Travis S. McGehee
*Assistant Examiner*—W. D. Bray
*Attorney, Agent, or Firm*—McGlew and Tuttle

[57] ABSTRACT

In a vertical type wood shearing machine having a blade holder and bar carrying unit and a substantially vertical support cable, the improvement being at least two wood stock support arms each pivotally mounted at one end thereof to the blade holder and bar carrying unit and pivotable from a support position with the arms extended away from the blade holder and bar carrying unit to a retracted position with the arms folded toward the blade holder and bar carrying unit. A double action hydraulic cylinder is associated with each of the support arms and is pivotally mounted at its one end to the blade holder and bar carrying unit and is pivotally mounted to an intermediate portion if each of said support arms at its other end. Each of the double action hydraulic cylinders are mounted at an angle so as to permit the extension of the support arm into the support position and a retraction of the support arms into a retracted position. The arms may be tapered so as to have a top surface inclined toward the blade holder and bar carrying unit to prevent the wood stock supported thereon from falling off the support arms. The arms in their extended position may further be used to push wood stock against the substantially vertical support table and thus insure the wood stock's close association with the support table.

12 Claims, 5 Drawing Figures

WOOD STOCK SUPPORT CONSTRUCTION FOR A BLADE HOLDER AND BAR CARRYING UNIT OF A VERTICAL TYPE WOOD SHEARING MACHINE

BACKGROUND OF THE INVENTION

1. Field of the Invention

This invention relates in general to a wood stock support structure for a vertical type wood shearing machine and in particular to a new and useful support arm construction which utilizes at least two pivotal support arms which are mounted to a blade holder and bar carrying unit of a vertical type wood shear machine, which are pivotable into a support position by double action hydraulic cylinders to support wood stock and which arms are usable to push wood stock against a substantially vertical support table of the vertical type wood shearing machine.

2. Description of the Prior Art

Vertical type wood shearing machines are known which comprise a substantially vertical support table for holding a piece of wood stock or timber. The support table is mounted on one or more slideways and connected to a vertical reciprocating device which moves the slide table in an upward and downard direction. Associated with the slide table on the shearing machine is a carriage supporting a blade holder unit and a bar carrying unit. The carriage is mounted on the shearing machine for substantial motion toward and away from the support table. A blade carried on the blade holding unit is brought into contact with the wood stock in the support table and utilizing the reciprocal motion of the support table, thin slices of wood may be cut from the wood stock or timber and utilized in the manufacture of veneers and the like.

Two problems exist in the manipulation of wood stock or timber when it is first brought into association with the shearing machine and when the wood stock or timber must be rotated through 180° in order to expose a fresh surface to be sheared by the machine.

The first of these problems concerns the positioning and adherence of the wood stock or timber to the vertical table of the shearing machine. The wood stock must be securely fixed to the vertical table in order to prevent any shifting or swinging of the wood stock and thus to insure a uniform cutting operation. It is known to provide the vertical table with hooks to lock the wood stock against the vertical table and to change these hooks to hooks with shorter lengths as the cutting process proceeds. This process is achieved by manual empirical operation and is thus time-consuming and wasteful of labor.

Two operators insert two wooden struts between the blade holder and bar carrying units of the wood shearing machine and the wood stock which is positioned in the vertical table. The blade holder and bar carrying unit is then advanced toward the wood stock to force it against the supporting table and properly engage and fix the wood stock with the supporting table. Such an operation is exceedingly dangerous for the operators in that they must be in close proximity to the machine while one of the machine members is in motion. In addition the process is costly and at least three persons are required to achieve the process.

The second problem in the aforementioned vertical shearing machine is that arising when the wood stock has been cut to one half its original width at which point it must be rotated 180° about its longitudinal axis in order to expose a new face to the shearing blade of the shearing machine. This rotation is customarily achieved during the operation to enable the wood to be sheared off in the direction most favorable to the fiber directions within the wood stock.

Up until the present time the wood stock was rotated manually by stopping the machine, connecting hooks to the wood stock which are connected to chains and a crane, extracting the wood from the shearing machine and placing it on the floor where the wood stock is rotated into its desired position. The crane then hoists the wood back into position in the shearing machine.

SUMMARY OF THE INVENTION

An object of the present invention is to solve the aforementioned problems by providing a device which does not require operators to manipulate the wood manually while in close proximity to moving shear machine members. In addition the wood stock need not be removed from the machine during a cutting operation and the consequential time delay is reduced.

The main features of the invention are two arms pivotally mounted to either the blade unit or the bar carrying unit of a wood shearing machine. The pivotal arms are connected to the lower one of these units and thus are usable in pushing the wood stock against a vertical table to aid in the fixing of wood stock to the vertical table.

The support arms are pivotable through 90° from an extended support position substantially perpendicular to the bar carrying and blade holding unit to a retracted position substantially parallel to the bar, carrying and blade holding unit and out of the way for the cutting operation of the shear machine.

Double action hydraulic cylinders are provided between an intermediate portion of each support arm and the bar carrying and blade holding units to extend and retract the aupport arms. The double action hydraulic cylinders are pivotally mounted within opposite ends of the blade holding and bar carrying unit and at an angle to the unit. This enables the double action hydraulic cylinders to rotate each support arm through a full 90°.

Each arm may be constructed with a slight taper in the direction away from the bar carrying and blade holding unit and included on its top surface toward the unit so as to enhance the support of the wood stock during its rotation by keeping the stock slightly inclined toward the blade holding and bar carrying unit.

Another object of the invention is to provide a wood stock support construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

DESCRIPTION OF THE PREFERRED EMBODIMENT

Figure 1:
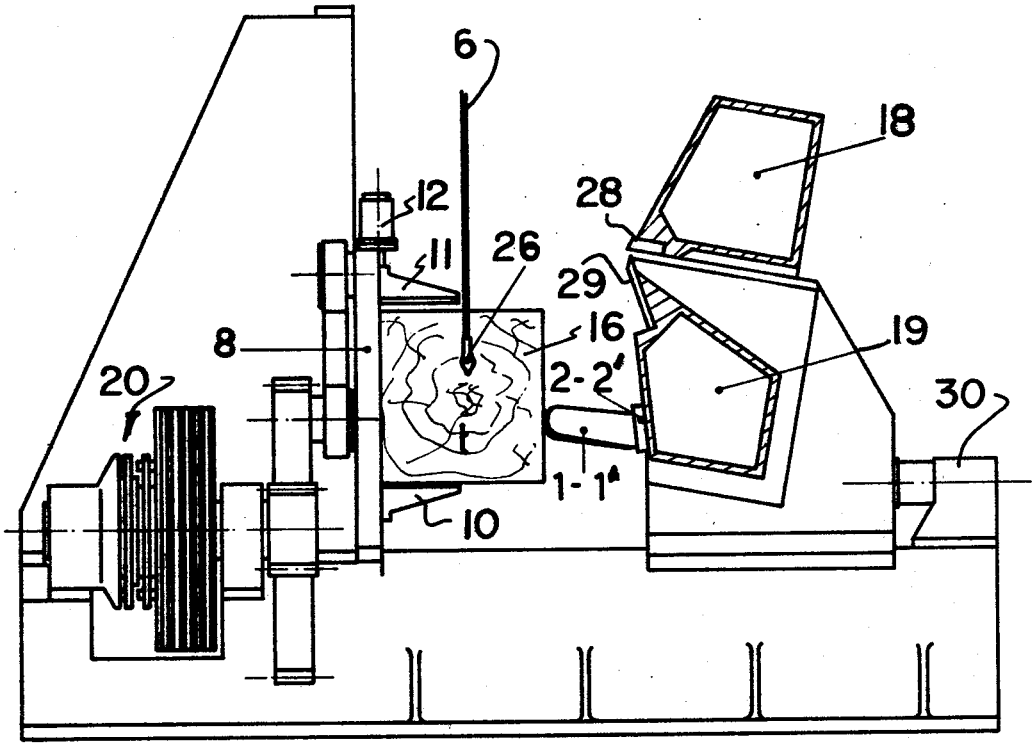
FIG. 1 is a partially in section side elevation of a vertical type wood shearing machine having extended support arms attached to the blade holding unit and in a position to push wood stock against the vertical table of the wood shearing machine.

Referring now to the drawings in particular there is embodied therein in FIG. 1 a vertical type wood shear comprising a support table 8 having a lower support jaw 10 which supports a timber or wood stock 16 and an upper clamping jaw 11 which is movable by a clamping cylinder 12 to engage the timber or wood stock 16 and secure it to the support table 8. Support table 8 is reciprocal in an upward and downward direction in a known manner by unit generally designated 20 connected thereto. The carriage generally designated 22 comprises a lower blade holder unit 19 which carries a cutting blade 29 and an upper bar carrying unit 18 which carries a guide bar 28. Carriage 22 is movable toward the support table 8 by means of a reaction box 30. When blade 29 is brought into proximity with the timber 16 veneer sheets may be cut from the timber 16 by the reciprocal action of the unit 20.

Support arms 1 and 1' are connected by hinge or pivotal joints 2 and 2' to the lower blade holding unit 19. As seen in FIG. 1 chain 6 is connected to hook 26 which in turn is engaged with the timber 16. Chain 6 can be connected to a crane not shown to manipulate the timber or wood stock 16 into position in front of the support table 8. At this point carriage 22 is slid toward support table 8 by the reaction box 30 and support arms 1 and 1' push the timber or wood stock 16 into close association with the support table in order to permit a proper fixing of the timber with the support table through the use of clamping jaw 11.

Figure 2:
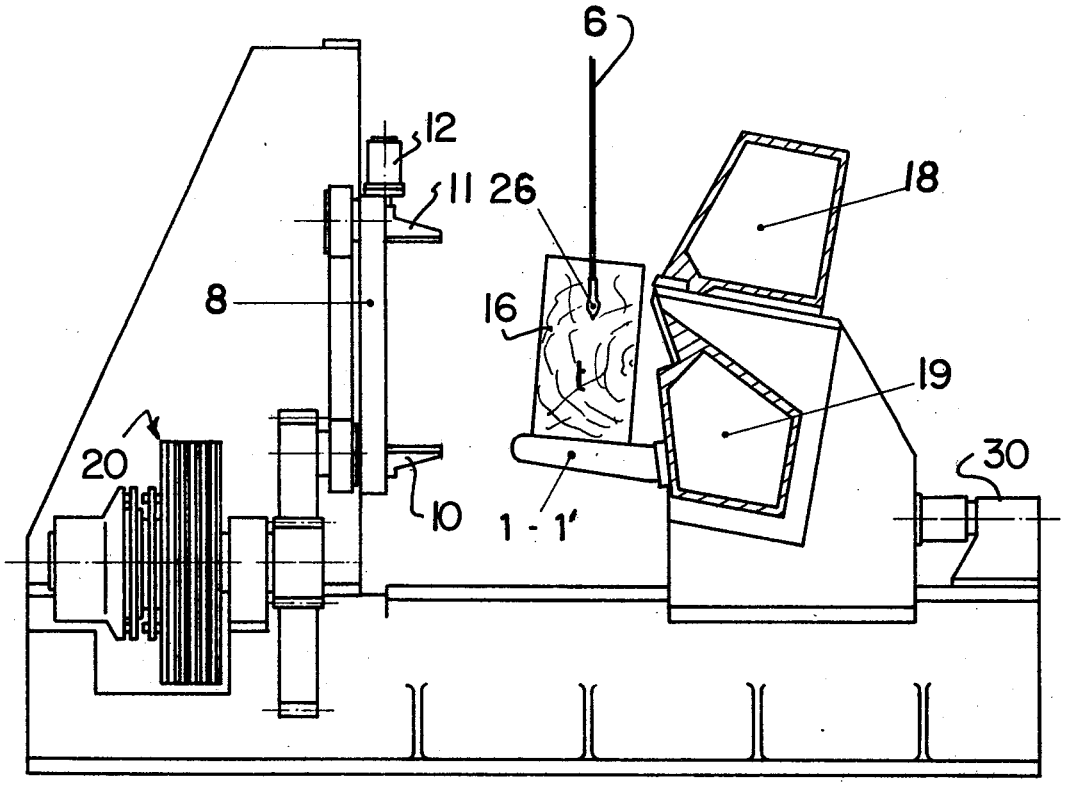
FIG. 2 is a figure similar to FIG. 1 showing the support arm extended and used to aid in the rotation of the wood stock while it remains in the shearing machine.
Figure 3:
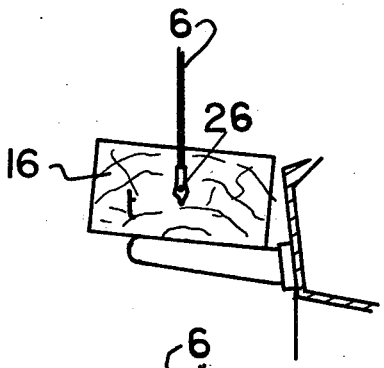
FIG. 3 is a side elevation of a portion of the embodiment of FIG. 2 showing the wood stock in an intermediate position in the rotation process.
Figure 4:
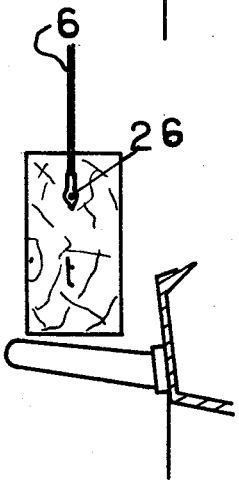
FIG. 4 is a figure similar to FIG. 3 showing a later position of the wood stock during a rotation process.

As seen in FIG. 2 timber or wood stock 16 may be rotated with the aid of hook 26 and chain 6 while the timber 16 is still within the shearing machine. Timber 16 is supported across support arms 1 and 1' and the timber can be lifted and rotated on the support arms 1 and 1' as seen in FIG. 3. In FIG. 4 the timber or wood stock 16 is shown just before its final position on the support arms 1 and 1' after the timber or wood stock 16 has been rotated 180° about its longitudinal axis.

Figure 5:
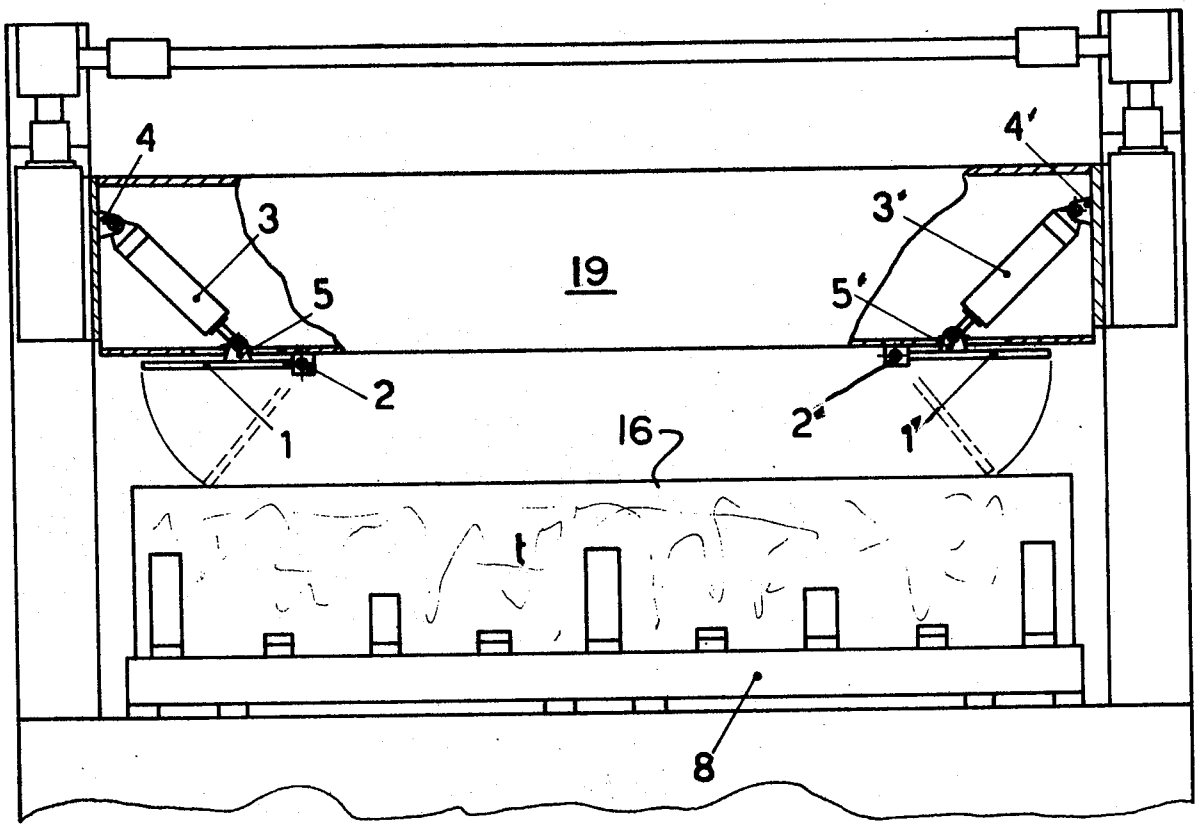
FIG. 5 is a partially in section top plan view of the wood shearing machine of FIG. 1 with the support arms in a retracted position.

As best seen in FIG. 5 the support arms 1 and 1' are pivotally connected to the blade holding unit 19 at hinge or pivot joints 2 and 2'. Double action hydraulic cylinders 3 and 3' are mounted at an angle within the blade holding units 19 at pivot points 4 and 4'. The piston of each cylinder 3 and 3' is connected to an intermediate portion of each support arm 1 and 1' at pivot joints 5 and 5'. The support arms 1 and 1' and their associated structure may be similarly attached to the bar carrying unit 18 if the positions of the bar carrying unit and the blade holding unit were reversed.

Support arms 1 and 1' are tapered away from the blade holding unit and have a top surface which is inclined toward the blade holding unit so as to improve the support of the timber or wood stock 16 and prevent its falling off the support arms 1 and 1'. The double action hydraulic cylinders 3 and 3' are positioned in the blade holding unit at an angle thereto to insure that each support arm 1 and 1' can be pivoted through a full 90°.

While a specific embodiment of the invention has been shown and described in detail to illustrate the application of the principles of the invention, it will be understood that the invention may be embodied otherwise without departing from such principles.

What is claimed is:

1. In a vertical wood shearing machine having a substantially vertical support table for holding wood stock, clamping means connected to the support table for securing the wood stock in an operative position on the support table, a cutting carriage having a side facing the support table including a blade-holding unit and a bar-carrying unit which cooperate to cut sheets of wood from the wood stock, means connected to the cutting carriage for moving it toward and away from the support table, and means connected between the support table and the cutting carriage for moving the support table and the cutting carriage in a vertical direction and in a reciprocal relationship to each other for cutting sheets of wood from the wood stock, the improvement comprising: at least one support arm connected to the carriage on the side of the carriage facing the support table and extending outwardly toward the support table for pushing the wood stock against the support table when the carriage is moved toward the support table and for supporting the wood stock from below when the wood stock is removed from the support table to be rotated about its longitudinal axis.

2. The improvement according to claim 1, wherein said blade holding unit is below said bar carrying unit and said support arm is connected to said blade holding unit.

3. An improvement according to claim 1, wherein said support arm is tapered in a direction away from the carriage and an upper surface of said support arm is inclined toward the carriage for maintaining the wood stock on the support arm when the wood stock is removed from the support table and for aiding in the rotation of the wood stock about its longitudinal axis.

4. The improvement according to claim 1, wherein said support arm is pivotally mounted to the carriage for movement of said support arm from an extended position extending toward the support table, to a retracted position with the support arm aligned along the carriage and away from the support table.

5. The improvement according to claim 4, further comprising a double action means connected between said support arm and the carriage for moving said support arm from the extended position to the retracted position.

6. The improvement according to claim 5, wherein said double action means is a double action hydraulic cylinder.

7. The improvement according to claim 6, wherein said hydraulic cylinder is connected at its one end to the carriage and at its respective other end to an intermediate portion of said support arm.

8. The improvement according to claim 7, wherein said hydraulic cylinder is mounted within the carriage and at an angle thereto for allowing said hydraulic cylinder to fully extend and retract said support arm.

9. A vertical wood shearing machine for shearing wood stock comprising a substantially vertical support table for fixedly holding the wood stock, a bar carrying and blade holding unit each having a side facing said support table movable toward and away from said support table, at least one support arm pivotally mounted to said blade holding unit on the side of said unit facing said support table for movement from an extended position extending toward said support table for pushing the wood stock against said support table and for supporting the wood stock from below when the wood stock is removed from its support table, and to a retracted position away from said support table and along said blade holding unit, and at least one double action hydraulic cylinder connected between said blade holding unit and an intermediate portion of said support arm to extend and retract said support arm into its extended and retracted positions.

10. A vertical wood shearing machine for cutting sheets from wood stock comprising, a frame, clamping means for holding the wood stock slidably mounted on said frame, drive means connected to said clamping means for reciprocably sliding said clamping means on said frame, a carriage connected to said frame and movable toward and away from said clamping means having a side facing said clamping means, a blade unit connected to said carriage having a blade projecting outwardly from the side of said carriage facing said clamping means, a bar unit connected to said carriage having a bar adjacent said blade for cooperation with said blade in cutting sheets from the wood stock, at least one support arm connected to said carriage adjacent said bar and said blade projecting outwardly from the side of said carriage facing said clamping means for aiding in the support and manipulation of the wood stock, and means connected between said support arm and said carriage for mounting said support arm to said carriage.

11. A vertical shearing machine according to claim 10, wherein said means between said support arm and said carriage includes a double action hydraulic cylinder having one end connected to said carriage and its other respective end connected to an intermediate portion of said support arm, said support arm being pivotally mounted to said carriage and said hydraulic cylinder being operable to extend said support arm outwardly toward said clamping means and into an extended position, and inwardly toward said carriage and into juxtaposition with said carriage.

12. A vertical shearing machine according to claim 10, wherein said blade unit is below said bar unit on said carriage and said support arm is connected to said blade unit.

* * * * *